US008754908B2

(12) United States Patent
Toader

(10) Patent No.: US 8,754,908 B2
(45) Date of Patent: Jun. 17, 2014

(54) OPTIMIZED ON-SCREEN VIDEO COMPOSITION FOR MOBILE DEVICE

(75) Inventor: Fabian Toader, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 152 days.

(21) Appl. No.: 13/154,733

(22) Filed: Jun. 7, 2011

(65) Prior Publication Data

US 2012/0313954 A1 Dec. 13, 2012

(51) Int. Cl.
*G09G 5/00* (2006.01)

(52) U.S. Cl.
USPC ..... 345/638; 345/502; 345/635

(58) Field of Classification Search
None
See application file for complete search history.

(56) References Cited

U.S. PATENT DOCUMENTS

| | | | | |
|---|---|---|---|---|
| 6,470,051 | B1 * | 10/2002 | Campisano et al. | 375/240.21 |
| 6,573,905 | B1 * | 6/2003 | MacInnis et al. | 345/629 |
| 6,828,982 | B2 | 12/2004 | Lee | |
| 6,983,017 | B2 * | 1/2006 | Chen et al. | 375/240.12 |
| 7,455,232 | B2 * | 11/2008 | Epshteyn | 235/462.11 |
| 7,548,245 | B2 | 6/2009 | Evans et al. | |
| 7,898,545 | B1 * | 3/2011 | Alben et al. | 345/519 |
| 2006/0117356 | A1 * | 6/2006 | Jojic et al. | 725/88 |
| 2008/0143749 | A1 | 6/2008 | Weybrew et al. | |
| 2008/0284798 | A1 | 11/2008 | Weybrew et al. | |
| 2009/0147854 | A1 | 6/2009 | Dane et al. | |
| 2009/0184977 | A1 | 7/2009 | Weybrew et al. | |

OTHER PUBLICATIONS

"Samsungs New Dual-Core Mobile Processor", Retrieved at <<http://phill.co/phone-reviews/sannsungs-new-dual-core-mobile-processor>>, Retrieved Date: Feb. 3, 2011, pp. 7.
"Shared Surface Hardware-Sensitive Composited Video", U.S. Appl. No. 12/912,941, filed Oct. 27, 2010, pp. 27.

* cited by examiner

*Primary Examiner* — Xiao Wu
*Assistant Examiner* — Steven Elbinger
(74) *Attorney, Agent, or Firm* — Tony Azure; Andrew Sanders; Micky Minhas

(57) ABSTRACT

A method for displaying continuous video content on a mobile phone LCD renders plural source video textures as consecutive surfaces on the display. A hardware scaler, rather than a general purpose graphical processing unit (GPU), is used to render a particular surface whenever possible, because it uses less battery power than the GPU. The method determines if the hardware scaler is capable of rendering a particular surface and if the particular surface is to be rendered with one or more additional images derived from a source other than a source video texture. The hardware scaler renders surfaces, including any additional images, if it is capable of doing so; otherwise the GPU renders the surface. The method is applied dynamically to each video texture in a video session, so that the manner of rendering each surface, whether by using the hardware scaler or the GPU, can change from surface to surface.

20 Claims, 6 Drawing Sheets

OPTIMIZED ON-SCREEN VIDEO COMPOSITION FOR MOBILE DEVICE

BACKGROUND

Mobile devices that can display video are becoming extremely popular. Microsoft Corporation, the assignee of the present application, makes mobile devices with such capabilities, an example of which is the Windows Phone® mobile phone environment. Many companies, including Microsoft Corporation, make other portable devices that provide the capability of displaying video content. A characteristic of mobile devices with such capability is often a small screen size and limited battery life.

In spite of those and other inherent limitations, consumers typically demand that such devices be capable of displaying video content in a form and with related content without compromising battery life, in a fashion similar to that possible with devices having greater processor capabilities and longer battery life.

SUMMARY

One aspect of the subject matter discussed herein is a method for reproducing continuous video content on a mobile phone LCD display by rendering plural source video textures as consecutive surfaces on the display. The method comprises (a) determining if a hardware scaler module is capable of rendering the particular surface, (b) rendering the surface using a general purpose graphical processing unit (GPU) if the response to the determining step (a) is negative, (c) determining if the particular surface is to be rendered with one or more additional images derived from a source other than a source video texture, (d) using the hardware scaler module to render the surface with the source video texture and any additional images if it is capable of doing so, and (e) repeating steps (a) through (d) for the next consecutive surface. As used herein, "continuous" video content refers to the successive display of frames of video data one after the other, typically at uniform intervals to reproduce a predetermined amount of the video data. A common real-time reproducing frequency is 60 frames per second, with slow motion, reverse and fast forward reproduction at higher or lower frequencies as the case may be. A video session is an uninterrupted time period in which multiple video textures are reproduced consecutively on the LCD surface, although it will be understood that a video session can involve the display of textures in an order different from that in which they were created.

It is preferable to use the hardware scaler to render surfaces on the LCD because it uses less battery power than the GPU. Efficient use of battery power is realized here by providing the capability of dynamically switching between the hardware scaler and the GPU for rendering the surfaces on a surface-by-surface basis, if necessary. Battery power can be further conserved by using for a next consecutive surface unchanged parts of a previous surface that would otherwise have to be generated again by the GPU for the next consecutive surface.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The objects of the subject matter discussed herein will be better understood from the detailed description of embodiments which follows below, when taken in conjunction with the accompanying drawings, in which like numerals and letters refer to like features throughout. The following is a brief identification of the drawing figures used in the accompanying detailed description.

FIG. 2, including

One skilled in the art will readily understand that the drawings are schematic in many respects, but nevertheless will find them sufficient, when taken with the detailed description that follows, to make and use the claimed subject matter.

DETAILED DESCRIPTION

Figure 1:
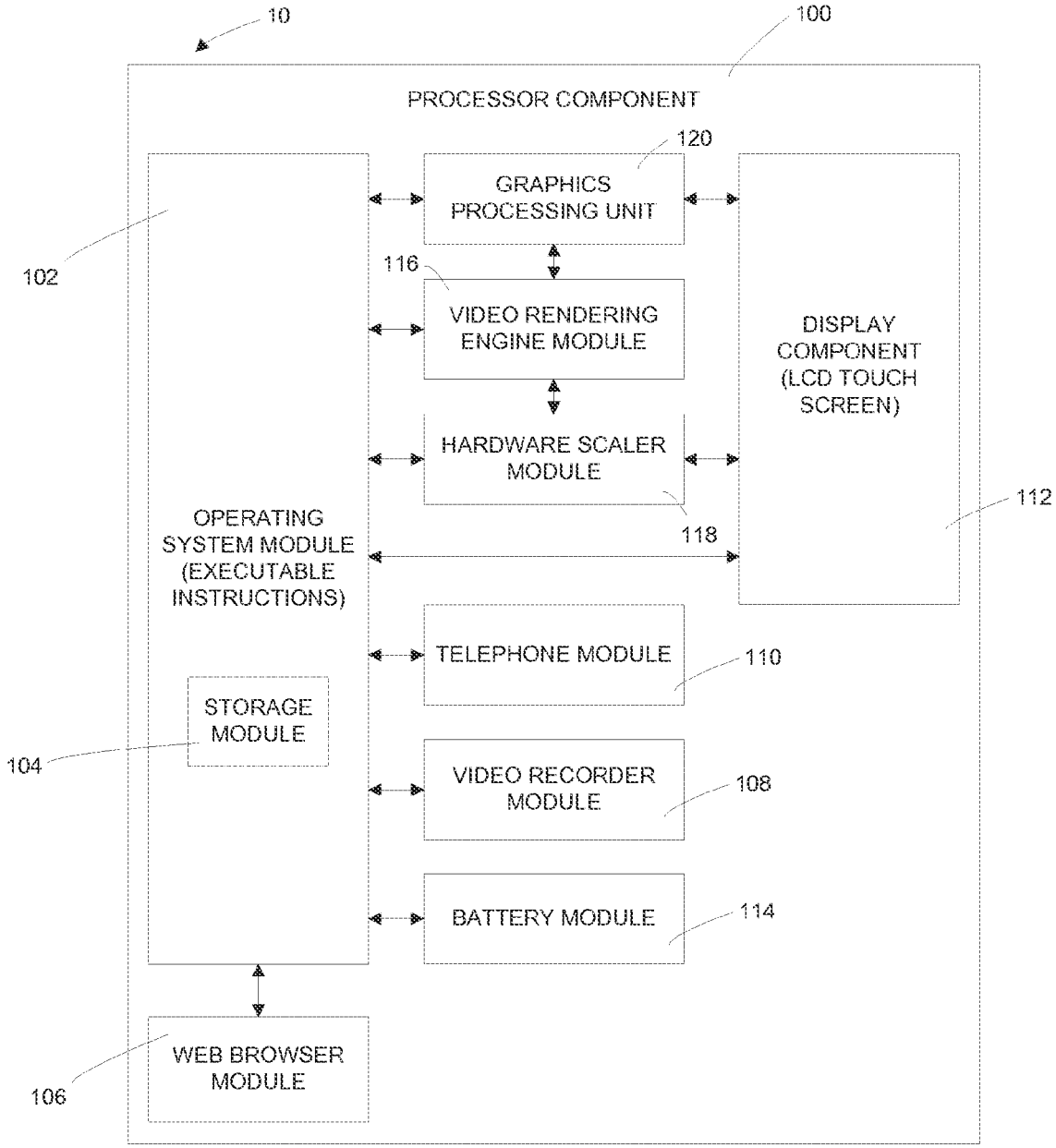
FIG. 1 depicts an example of a mobile device incorporating features in accordance with one embodiment of a system capable of implementing the video rendering procedures discussed and claimed herein.

FIG. 1 schematically illustrates a mobile device 10 capable of implementing the video rendering methods discussed herein. The mobile device 10 includes a processor component 100 that comprises an operating system module 102. The operating system module is typically stored on a non-transitory computer storage medium or device (not shown) suitable for storing the executable instructions of the operating system software that control the operation of the mobile device. A storage module 104 provides temporary storage for various information, among which is certain video content captured by the device 10 in a variety of possible ways.

The processor component 100 further includes a web browser module 106 that is a particular type of executable program under the control of the operating system module 102, that allows a user of the mobile device to access or otherwise navigate to websites and download files. Access to websites on the Internet can be gained through well-known protocols embodied in firmware and/or software included in the web browser module 106. A typical such protocol is commonly known as Wi-Fi, but there is no limitation on the manner in which the device might access content from remote locations, including wired connections conforming to the well known USB standard or by the use of a portable memory device physically plugged into the device, just to name some examples. In any event, relevant to the present embodiment, the web browser module or other content source is operable to download video content to the device 10. In a typical arrangement the video content will be stored temporarily in the storage module 104 prior to further processing and display as explained in more detail further below. Video content can also be captured by a video recorder module 108 that is included in the mobile device 10 and is under the control of the operating system module 104. The mobile device has controls (not shown) by which a user can activate a video recording device included in the video recorder module 108. Typically, the video recorder module 108 will include features such as a zoom lens and other video recording controls operable by the user. Video content from whatever source derived is typically captured as a series of textures that are stored as blocks or frames of video data in the temporary storage module 104.

In the embodiment depicted, the mobile device 10 also includes a telephone module 110 that is under the control of the user via the operating system module 102. The telephone module includes the necessary circuitry and other components for connecting to cellular telephone networks in a conventional manner well known to those skilled in the art. The telephone module 110 is also capable of interacting with the web browser module 106 to download content from the Internet by various conventional protocols. A display component 112 provides a user interface by which information is conveyed to the user of the device. The display component in one embodiment is an LCD (liquid crystal display) that displays a touch screen through which the user can input commands to the operating system module 102. Such touch screen displays are also well known to those skilled in the art, who will be able to implement an LCD or other display as described herein without further explanation. The mobile device may also have other input devices such as conventional mechanical-electrical buttons and/or toggle switches (not shown in FIG. 1) for entering commands to be executed by the operating system. A battery module 114 includes a rechargeable battery for providing electrical power to the components of the device under the control of the operating system module, which will typically perform functions such as monitoring the amount of battery power remaining and providing corresponding information regarding same to the user on the display component 112.

It will be appreciated that the components of the device 10 thus far described are not exhaustive of the components that can be incorporated into a mobile device suitable for performing the video composing techniques described herein. For example, the device would typically also include a still photograph function and would also include an email application. It could further include a mapping function that enables the user to determine his or her position by displaying on the display component 112 a position indicator superimposed on a street map. The device will also typically include a module that enables a USB port for functions already discussed, as well as others, such as enabling the device to be physically connected to another electronic device to exchange information with such device (sometimes referred to as "synching") and/or to an electrical outlet for recharging the battery included in the battery module 114.

As used in this description, the terms "component," "module," "system," "apparatus," "interface," "unit" or the like are generally intended to refer to a computer-related entity or entities, either hardware, a combination of hardware and software, software, or software in execution, unless the context clearly indicates otherwise. For example, such a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer (device) and/or distributed between two or more computers (devices). Nor does the schematic depiction in the manner used herein of modules, components or units for performing various functions imply that such modules, components or units are physically separate or comprise discrete entities within a device for performing the methods and embodying the systems described herein. In other words, these depictions are not meant necessarily to represent discrete hardware entities, but rather as functional components that can be realized by one skilled in the art in any suitable fashion using hardware, software, or firmware in accordance with the description herein.

Further, a "computer storage medium" as used herein can be a volatile or non-volatile, removable or non-removable medium implemented in any method or technology for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium that now exists or may become available in the future that can be used to store the desired information and which can be accessed by a computer.

The mobile device 10 described here is meant to be only one example of an electronic device for effecting the video composition methods described herein. It is intended that "electronic device" be considered broadly as including any such device (or any physical or logical element of another device, either standing alone or included in still other devices) that is configured for communication via one or more communication networks such as those described herein and that is responsive to user inputs. While the methods described herein have particular utility when applied to battery-powered handheld mobile devices capable of performing some or all of the functions (or more) described above, those skilled in the art will immediately recognize that all manner of electronic devices may be adaptable to effect the methods to be described, examples of which electronic devices could include, but would not be limited to, mobile phones, personal digital assistants, smart phones, laptop and desktop computer systems of any configuration or implementation, personal media players, image or video capture/playback devices, devices temporarily or permanently mounted in transportation equipment such as planes, trains, or wheeled vehicles, set-top boxes, game consoles, stereos, digital video recorders/players, and televisions.

Returning now FIG. 1, the device 10 includes three other modules that are used to effect the video composition/rendering methods discussed herein. A video rendering engine module 116 that receives video data supplied by the operating system module, for example, and provides the data to a hardware scaler module 118 and/or a general purpose graphical processing unit 120. The hardware scaler module 118 is a conventional firmware component, implemented in one embodiment as an MDP chipset, that can perform some but not all of the functions performed by the GPU. That is, the hardware scaler module is specifically configured to perform certain functions that the general purpose GPU can perform, but since it is specifically designed for that purpose, it typically uses less battery power than the GPU. An important aspect of the methods and systems described herein is to dynamically process the video data for a video session on a surface-by-surface basis, using the hardware scaler module for those surfaces that it can render and using the GPU only for those surfaces for which it is required. It will also be appreciated that the video rendering engine 116 and the GPU 120 are of conventional construction and configuration, and that no further description thereof will be necessary for one skilled in the art to implement them in accordance with the description herein.

As noted above, the source video data to be displayed (rendered) on the display component 112 is organized into blocks of data, each of which is rendered as a surface of the LCD display component 112. One of the functions of the video rendering engine module 116 is to organize digital video data, captured in one of the ways discussed above, for example, into addressing data for activating the rows and columns of the LCD display electrodes so as to render one such block of video data (also sometimes referred to as a "texture") onto a surface of the LCD. By rendering such surfaces of the LCD display one after the other in succession in a video session, the video data is recreated on the display.

However, the source texture data may not be in a form or obtained in a manner that readily permits generation of surfaces for rendering on the LCD. For example, digital video data typically comprises a two-dimensional matrix of pixels ("picture elements"), each of which includes a sufficient number of bits to define the characteristics of the texture at the point represented by a particular pixel. Typical resolutions for an LCD display component on a so-called smartphone mobile device are from 240×320 pixels to 640×960 pixels, with a common resolution being 480×800 pixels. Usually, a user will desire that the source texture be matched to the LCD screen surface resolution, which might require scaling the source texture either up or down. In addition, many source textures are encoded in YUV color space, while most LCDs render images in RGB color space. Conversion algorithms are well known, but the source texture will have to be YUV-RGB converted before the image can be rendered for display on the LCD display component 112.

The hardware scaler module 118 and the GPU 120 perform operations on a source texture that enable it to be rendered as a surface on the LCD along with other items. Taking the hardware scaler module 116 first, it is typically designed to perform various predetermined source texture manipulations. The GPU module 120 can perform all of the functions of the hardware scaler module, but the latter performs those particular functions for which it designed using less power than a typical graphical processing unit. However, by the same token a typical general purpose GPU can perform functions that the hardware scaler cannot. For example, a typical MDP chipset is particularly efficient in terms of power usage for converting from YUV color space to RGB color space and for scaling a given source texture to the resolution of the particular LCD display screen in use. However, unlike most GPUs, a typical MDP hardware scaler chipset now in use usually cannot stretch a given texture to more than eight times its original resolution, or shrink it to less than one-fourth of its original resolution. It also cannot process textures smaller than 64×64 pixels, and can rotate images only in 90° increments. In addition, it cannot provide images that appear partially or wholly transparent so as to be able to display one image that appears to be on top of another while maintaining some visibility of the "bottom" image. The transparency of an image is typically termed "alpha" ($\alpha$), with values between 0 (opaque) to 100 (totally transparent, that is, not visible). An MDP chipset can normally only render images with $\alpha=0$.

Finally, of relevance to the methods and systems of the present description, an MDP chipset of the type typically used in a mobile device like that discussed herein cannot generate video images except for filling with black video data areas of the display other than the video texture. That is, if the source texture has an aspect ratio (width divided by height) that is different from the LCD surface aspect ratio, the texture must either be stretched or shrunk to match the LCD aspect ratio, or be displayed with borders (sometimes referred to as a "letterbox" format). A typical MDP chipset can only render these border areas in black. For purposes of this discussion, a display mode using the hardware scaler unit to render a surface comprising only source video content rendered by the MDP hardware scaler module is in this description referred to as the "secondary only optimized" mode. This display mode is discussed in more detail further below in connection with FIG. 4. This is the optimum display mode in terms of preserving battery life. A display mode in which the source video texture is rendered with one or more rectangular black areas generated by the MDP hardware scaler module is a secondary only mode and an example is depicted in FIG. 5. A display mode including secondary images (source video texture and/or one or more black areas), along with a surface generated independently of the MDP hardware scaler chipset (a "primary image"), is referred to as the "primary-with-secondary blend mode." This display mode is discussed in more detail further below in connection with FIGS. 6 and 7.

Figure 2A:
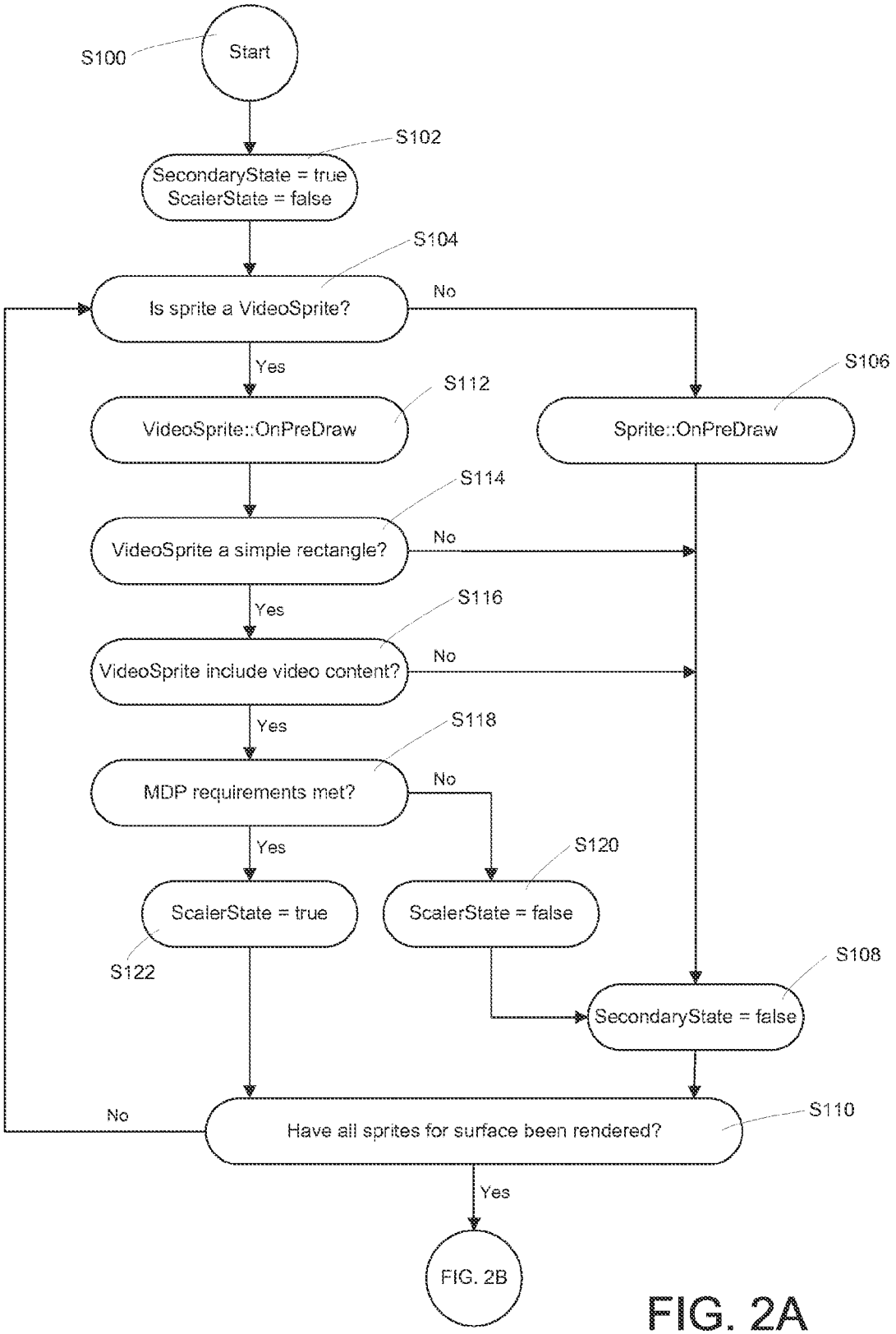
FIGS. 2A and 2B, is a flowchart illustrating one method to enable a system as described herein to render video content in a manner that optimizes its presentation and preserves battery life of a device implementing the method.
Figure 2B:
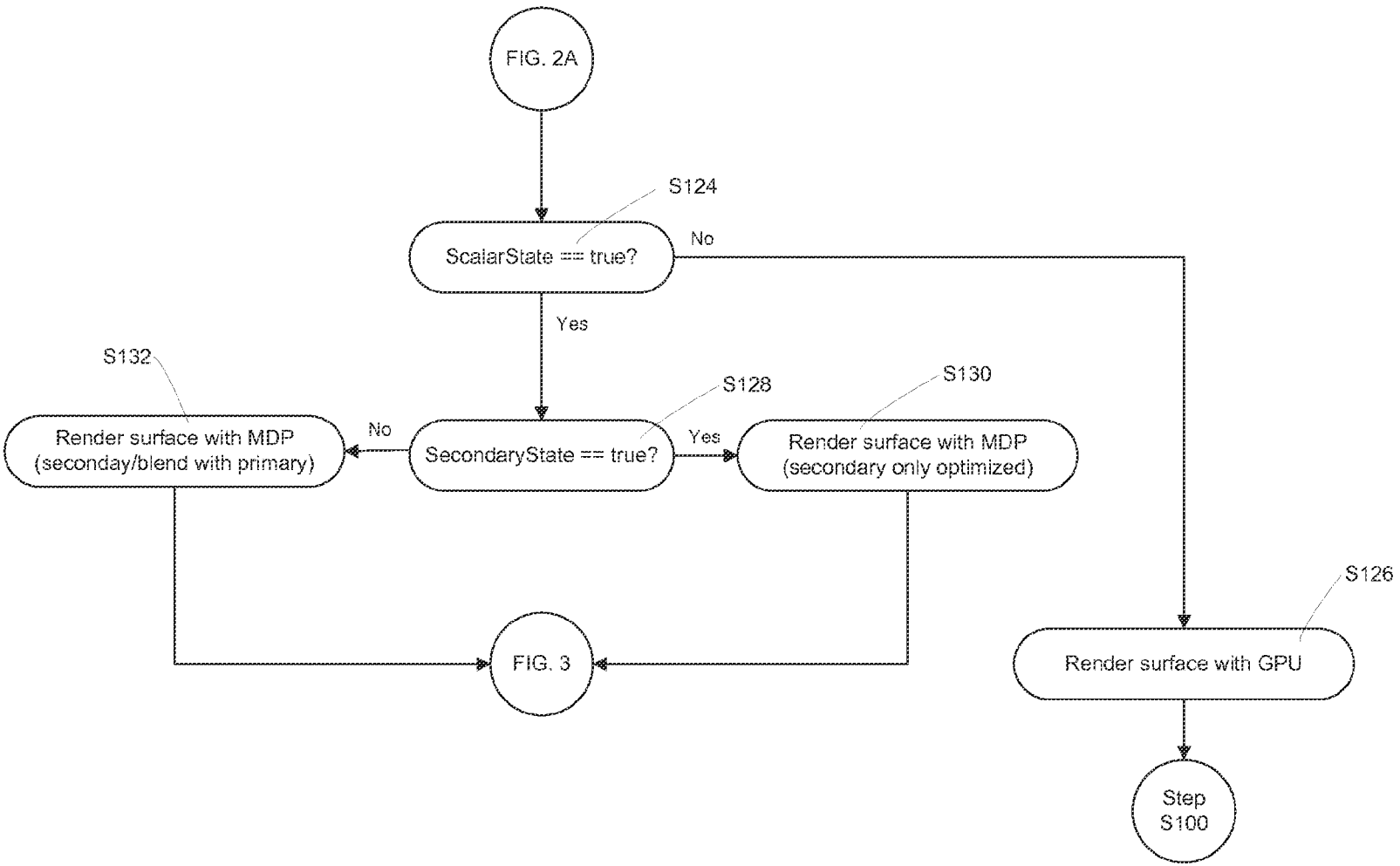

The flowchart in FIGS. 2A and 2B will facilitate understanding of the rendering methods discussed herein. The software for executing the algorithm represented by the flowchart in FIG. 2 is usually considered as part of the video rendering engine module 116, but it is well within the capability of one skilled in the art to implement this flowchart in software executed by one or more other components of an electronic device. In any event, in accordance with one embodiment the rendering process for a given video session starts at a step S100 and proceeds to a step S102 where a SecondaryState flag is set to "true" and a ScalerState flag is set to "false." The purposes of these flags are discussed further below. Typically, the flags discussed herein will be one or more bits of digital data, but the designations "true" and "false" are used herein to facilitate understanding.

For purposes of this description a particular block or set of video data to be rendered on the LCD surface is considered as one or more generalized "sprites," which are processed in turn for each LCD surface being composed. A step S104 determines if a sprite is a particular subset of sprites referred to herein as VideoSprites. In a typical implementation, a VideoSprite is a sprite that comprises the source video texture or the information used to render border areas for displaying a letterbox format as discussed above. Other sprites, that is, non-VideoSprites are processed differently, as will be discussed. Typically, the data defining a sprite in some fashion further identifies it as a Video Sprite. One example of a sprite that is not a VideoSprite is an image generated by the GPU and displayed on the LCD as video transport controls such as "Play," "Pause," Fast Forward," "Reverse," "Full Screen," and the like. (See FIG. 6, discussed in more detail below.) The user can activate a desired transport control by touching the LCD screen where it is displayed. Another example of a generalized sprite (that is, a non-Video Sprite) is text, such as a title caption, that will be visible on part of the LCD surface being composed for display. (See FIG. 7, discussed in more detail below.) The data accompanying the sprite will also specify where on the LCD it should be displayed. In one typical application, primary images, such as transport controls, are displayed when the operating system module receives a signal from the LCD display that a user has touched it and generates a command to the video rendering engine module that a non-VideoSprite (that is, a "primary image") is to be displayed along with the source video texture.

The process depicted in FIGS. 2A and 2B assumes that all of the sprites in particular surface being rendered have been identified by the video rendering engine module 116. A particular video session begins at the step S100, and proceeds through the step S102 discussed above, to a step S104. Here, the video rendering engine module 116 determines whether or not the sprite currently being processed is a "VideoSprite." If the determination in the step S104 is that the sprite is not a VideoSprite, the process proceeds to a step S106 where the video rendering engine module 116 activates a "PreDraw" routine typically resident in the video rendering engine module 116 that retrieves from a memory location the data needed to "draw," that is, render, the sprite on the LCD surface. This data is typically prestored and includes information such as RGB information for each pixel of the sprite and address coordinates of the LCD display where each pixel is to be displayed. The process then proceeds to step S108 where the SecondaryState flag is set to "false." The process then proceeds to a step S110 where it is determined whether or not all of the sprites comprising the surface being composed have been processed. If not, the process returns to the step S104. If the next sprite being processed is a VideoSprite, the process will proceed to a step S112 in which the "predraw" routine is activated in preparation for rendering the VideoSprite. This step is analogous to the step S106, except that this predraw subroutine enables the hardware scaler module to render the source video texture or generate blank video data for rendering the VideoSprite as a black area on the LCD surface. Note that if the first sprite processed is a VideoSprite, the process will go to the step S112 first and the SecondaryState flag will still be "true."

The next step is a step S114 in which the video rendering engine module determines if the VideoSprite is to be rendered as a simple rectangle on the LCD surface. For purposes of the present discussion, a "simple rectangle" is a VideoSprite that points to LCD screen coordinates that define a rectangle oriented at 0°, 90°, 180°, or 270° relative to the LCD screen pixels, and that does not contain color gradients. If the VideoSprite does not represent such a simple rectangle, it is generated by the GPU module for rendering as a primary image. The process then proceeds to the step S108, which sets the SecondaryState flag to "false." If the VideoSprite is a simple rectangle, the process proceeds to a step S116 where it is determined whether or not the VideoSprite includes video content. If the VideoSprite does not include video content, that is, is not the source video texture but blank video data to be rendered as a black area on the LCD surface by the hardware scaler module, the process goes to the step 108, where the SecondaryState flag is set to "false."

Next, if the step S116 determines that a VideoSprite has video content (that is, that it comprises source video texture), then the process proceeds to a step S118. Here it is determined if the VideoSprite representing the source video content can be rendered by the hardware scaler module 118. As noted above, the hardware scaler module has limited capabilities vis-à-vis the GPU module 120. For example, one conventional MDP chipset embodying the hardware scaler module as discussed above cannot stretch a given texture more than a predetermined amount (eight times in the present example), or shrink it to less than a predetermined fraction of its original resolution (one-fourth in the present example), and it cannot process source video textures smaller than a certain size (64 pixels×64 pixels in the present example). In addition, it can normally only render images with $\alpha=0$ (opaque). If the VideoSprite cannot be rendered by the MDP hardware scaler chipset as requested by the video rendering engine module, the step S118 proceeds to the step S120, where the ScalerState flag is set to "false," and then to the step S108 where the SecondaryState flag is also set to "false." If, however, the source video texture can be rendered by the hardware scaler module 118, the process proceeds from the step S118 to the step S122, where the ScalerState flag is set to "true" The process continues to compose the LCD surface in accordance with the flowchart in FIG. 2A until all of the sprites comprising the surface have been rendered, at which point the process proceeds from the step S110 to the portion of the flowchart in FIG. 2B. It will be appreciated that once the ScalerState flag is set to "false," it will not change for any particular surface being rendered. It will also be appreciated that at least one VideoSprite pixel coordinate must be within the outer boundaries of the LCD display, since otherwise nothing of the VideoSprite will be visible to the user. If that is the case, the VideoSprite is not rendered at all.

In a step S124 the ScalerState flag is checked. If it is not "true," it means that the MDP hardware scaler is not capable of rendering the source video content (see the step S120), or any of the rest of the surface either (since the default state of the ScalerState flag is "false," as per the step S102). After the GPU renders the current surface, the process returns to the step S100 and renders the next surface. If the ScalerState flag is "true" in the step 124, it means that the MDP hardware scaler module is capable of rendering the surface, and the process goes to a step S128, where the SecondaryState flag is checked (otherwise, step S126 is performed). If it is "true," it means that only the source video texture is being rendered, and the process proceeds to a step S130 in which the hardware scaler module renders the surface in a secondary only optimized mode (see FIG. 4). If the SecondaryState flag is not "true," the process proceeds to a step S132 in which the MDP hardware scaler module renders the surface in a secondary only mode (FIG. 5) or a primary-with-secondary blend mode (see FIGS. 6 and 7).

Figure 4:
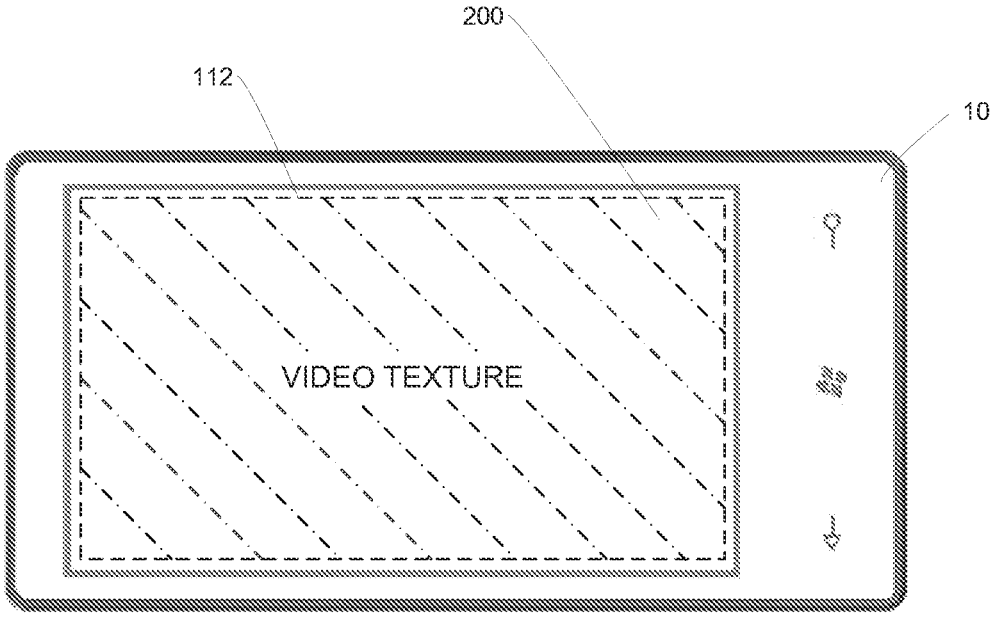
FIG. 4 depicts a front view of a mobile device with source video texture rendered in a secondary only optimized mode in accordance with the method represented by the flowchart in FIG. 2.
Figure 5:
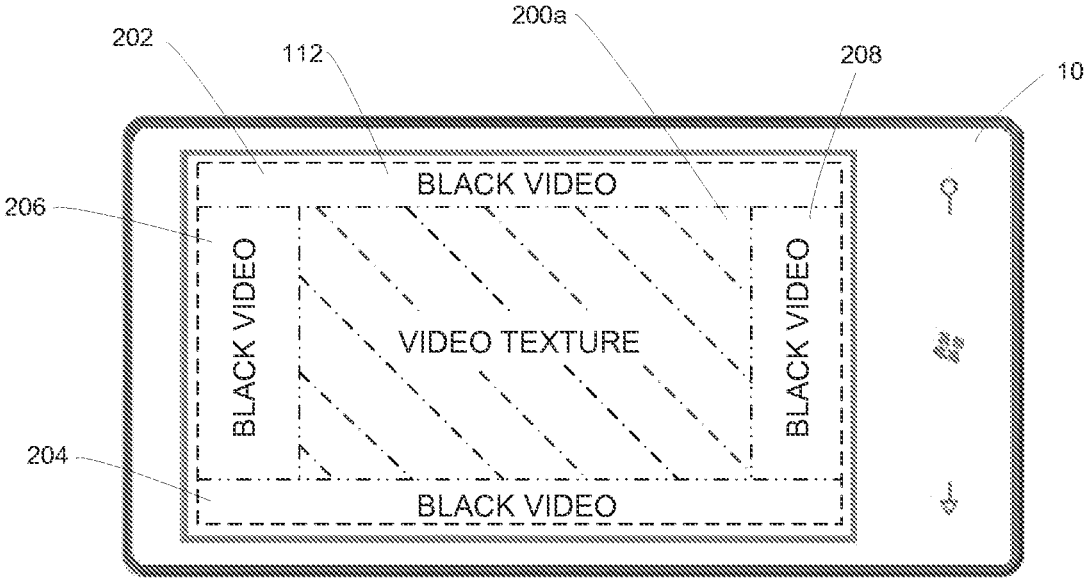
FIG. 5 depicts a front view of a mobile device with source video texture rendered in a secondary only mode in a letter-box format in accordance with the method represented by the flowchart in FIG. 2.
Figure 6:
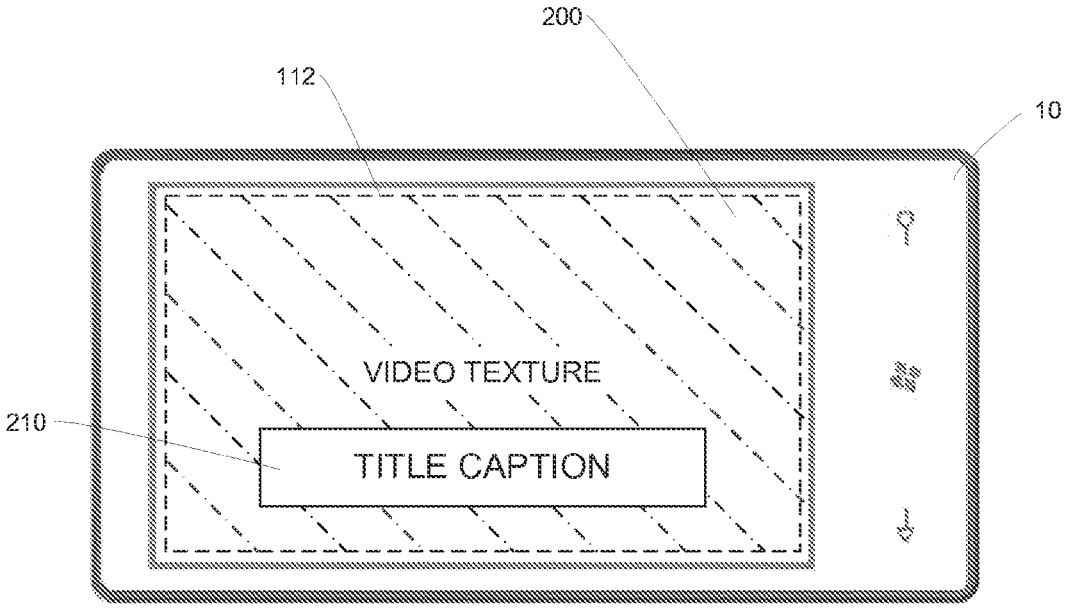
FIG. 6 depicts a front view of a mobile device with source video texture rendered as shown in FIG. 4 in a primary-with-secondary blend mode.
Figure 7:
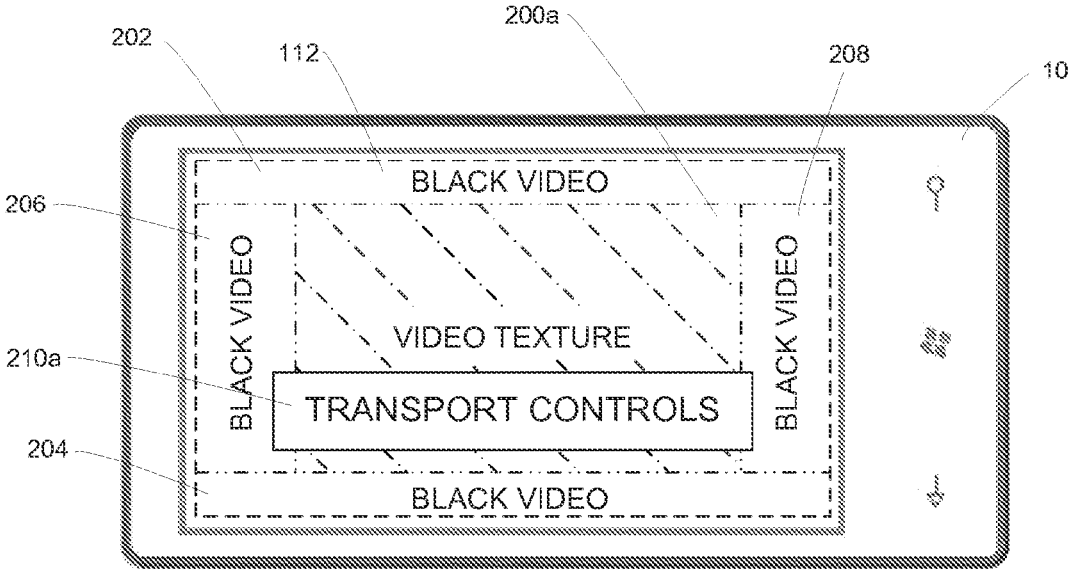
FIG. 7 depicts a front view of a mobile device with source video texture rendered as shown in FIG. 5 in a primary-with-secondary blend mode.

Further details of the process thus far described are better understood by referring to FIGS. 4-7. FIG. 4 shows a front view of a mobile device 10 with an LCD display 112 having a source video texture 200 rendered on it that matches the LCD size. This is the display mode referred to as the "secondary only optimized" mode. This is the optimum mode for display in terms of battery life. FIG. 5 is a front view of the device 10 with a source video texture 200*a* rendered thereon at a size smaller than the LCD surface, surrounded by four black VideoSprites 202, 204, 206, and 208. That is, the MDP hardware scaler module 118 can provide up to four black rectangles as video data, but they do not include video content, and are rendered as black VideoSprites, which generate "Yes" responses in the steps S104 and S114, but a "no" response in the step S116 (resulting in the SecondaryState flag being set to "false."). FIG. 6 represents the surface in FIG. 4 with a primary image (in this case a text title caption 210) rendered by the hardware scaler module along with the source video texture as shown in FIG. 4. This is one example of the "primary-with-secondary blend" mode referred to above. FIG. 7 represents the surface in FIG. 5 rendered by the hardware scaler module with a different primary image (in this case video transport controls shown schematically at 210*a*). It should be understood that more than one primary image (such as transport controls and a text caption) can be displayed at the same time. In summary, the source video texture 200, the source video texture 200*a*, and the four black VideoSprites 202, 204, 206, and 208 are all "simple rectangle" VideoSprites. Thus, when the video surface is being composed in either of the secondary only modes or in the primary-with-secondary blend mode, the step S114 determines that each VideoSprite is a simple rectangle.

Figure 3:
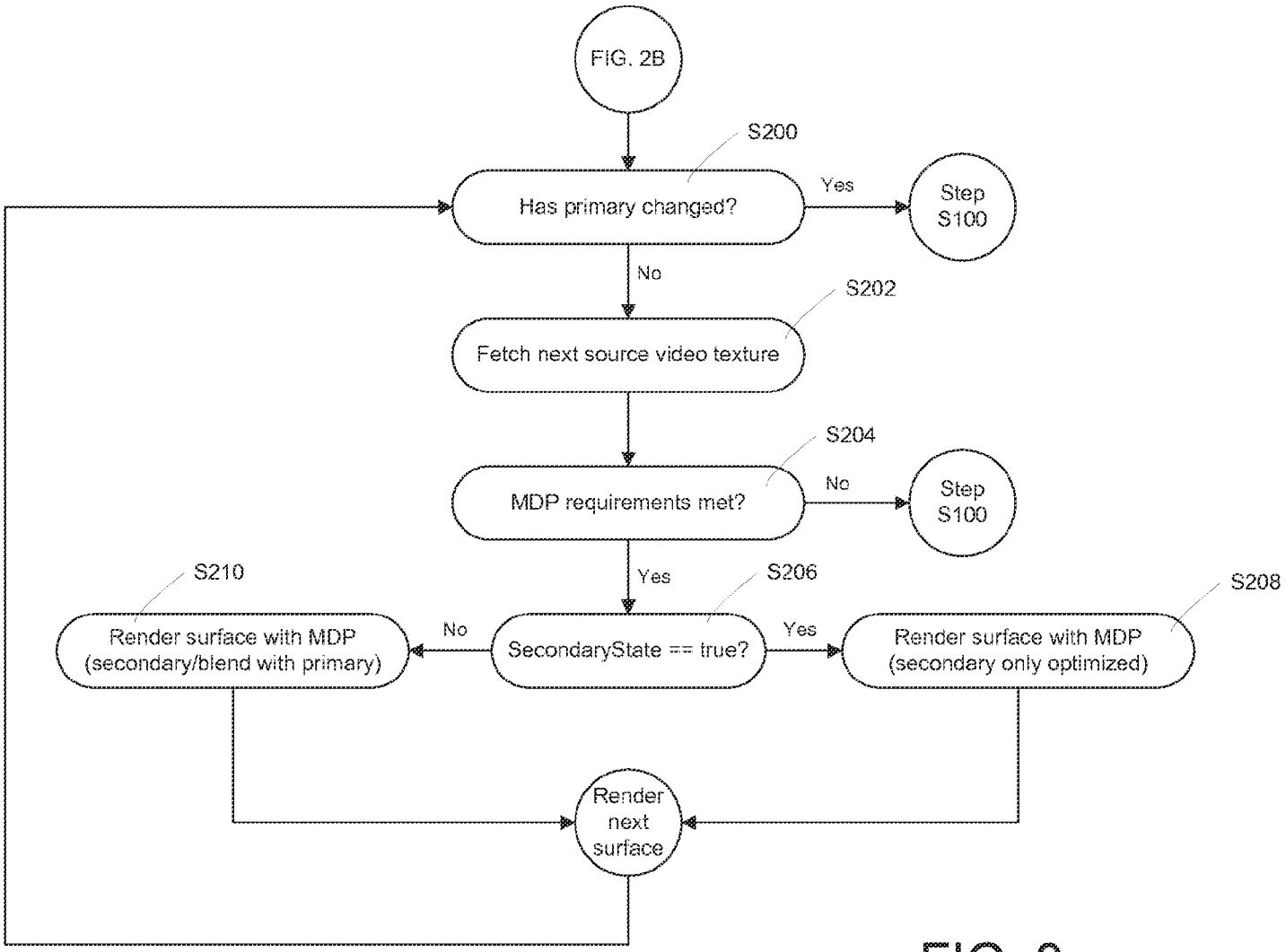
FIG. 3 is a flowchart illustrating an alternate method for rendering successive video surfaces.

After the current surface is rendered either in the step S130 or the step S132, the process could return to the step S100 and render the next surface from scratch, as it were. However, if the primary image (in the examples mentioned above, text such as a title caption as depicted in FIG. 6 or transport controls as depicted in FIG. 7), has not changed, it is not necessary that the entire flowchart of FIGS. 2A and 2B be repeated. In that case, the process can optionally proceed to the flowchart in FIG. 3, where in a step S200 the process determines if the primary image has changed or if a primary image is newly present. If so, the process returns to the step S100 in FIG. 2A to generate the new primary image for blending with the secondary. The same is true if the primary image was removed or has begun to fade (by, say, the expiration of a time period during which the user has not activated any of the displayed transport controls). If the response to the determination in the step S200 is negative, the process fetches the next source video texture in a step S202.

The only determination that needs to be made to enable the hardware scaler module to compose this surface is to confirm in a step S204 that the new source video texture meets the MDP chipset requirements (the step S204 corresponds generally to the steps S114 and S118 in FIG. 2A). If not, the process returns to the step S100 in FIG. 2A so that the GPU module can be used to render the new surface. If the source video texture can be rendered by the MDP hardware scaler module, then it is determined in a step S206 whether the SecondaryState flag is "true" or "false." If it is true, as a result of the rendering of the immediately preceding video surface (say by the method depicted in FIG. 2A), then the surface is rendered in a step S208 using just the source video texture (FIG. 4). This step is comparable to the step S130 in FIG. 2B. If the SecondaryState flag is false, it means that the surface is rendered at step S210 with the black areas generated previously, and a primary image if the same one was present previously. This step is comparable to the step S132 in FIG. 2B, and will render surfaces such as those depicted in FIGS. 5-7.

As described, there are essentially four manners in which the present method and apparatus can compose each of a succession of video surfaces. One is to render a new primary image and a new secondary image. For example, if transport controls are displayed, or they are to appear for the first time, they must be redrawn or initially drawn in rendering the next consecutive surface. This new surface cannot be rendered using the flowchart in FIG. 3, and must be rendered by proceeding through the flowchart in FIGS. 2A and 2B. In addition, a new frame of the source video texture must be rendered, as well. A second is a surface in which the primary image has not changed from the previous surface. In that case the primary image that was generated for the previous surface can be used when rendering the next source video texture. This can be done per the flowchart in FIG. 3, without performing all of the steps in the flowchart of FIGS. 2A and 2B. This further preserves battery power. A third is to render a new primary with the same secondary (for example, during a period when a video playback session is paused). To provide for further battery power savings in this scenario, the flowchart in FIG. 2 could be modified to include a step in which it is determined if the secondary image has changed from the previous surface, in which case the steps S112 to S122 could be omitted. Finally, if there was no primary image in the previous surface and none is being rendered in the next surface, that next surface can be rendered in accordance with the flowchart in FIG. 3.

The hardware scaler module 118 is typically capable of rendering video content from more than one source video. For example, this could be done by rendering the different video textures as a split screen surface on the LCD display, or in a "picture-in-picture" format wherein one or more additional source video textures are rendered in small boxes in a surface comprising a main source video. The methods and apparatus described above can utilize that capability as well. That is, since a typical hardware scaler module is capable of rendering multiple VideoSprites (five in the above described embodiment), more than one of the VideoSprites can include video content, as opposed to only one of them as described above. In effect, one or more of the black VideoSprites generated by the hardware scaler module can be video content instead. One skilled in the art will be readily able to make the necessary modifications to the flowcharts discussed above to effect this alternate embodiment.

Unless specifically stated, the methods described herein are not constrained to a particular order or sequence. In addition, some of the described method steps can occur or be performed concurrently. Further, the word "example" is used herein simply to describe one manner of implementation. Such an implementation is not to be construed as the only manner of implementing any particular feature of the subject matter discussed herein. Also, functions described herein as being performed by computer programs are not limited to implementation by any specific embodiments of such program.

Although the subject matter herein has been described in language specific to structural features and/or methodological acts, it is to be understood that the subject matter of the appended claims is not limited to the specific features or acts described above. Rather, such features and acts are disclosed as sample forms of corresponding subject matter covered by the appended claims.

What is claimed is:

1. A method for displaying continuous video content in a video session by rendering plural source video textures as consecutive surfaces on a display, the method comprising:

(a) determining if a hardware scaler module is capable of rendering all of a particular surface, the hardware scaler module having a first rendering mode and a second rendering mode, the first rendering mode comprising a secondary-only-optimized mode and the second rendering mode comprising a secondary-only mode;

(b) rendering the surface using a general purpose graphical processing unit (GPU) if the response to the determining step (a) is negative, the graphical processing unit requiring greater power than the hardware scaler unit to operate, the hardware scaler unit configured to perform only a subset of graphic operations performable by the graphical processing unit;

(c) determining if the particular surface to be rendered comprises one or more additional images incapable of rendering by the hardware scaler by iterating through the one or more additional images;

(d) when:

the determining step (a) is affirmative and the determining step (c) is not affirmative, and it is determined that the surface does not comprise letterboxing portions: using the hardware scaler module in the first rendering mode to render the surface, the determining step (a) is affirmative and determining step (c) is not affirmative, and it is determined that the surface comprises letterboxing portions, wherein the surface comprises only video data renderable by the hardware scaler and letterboxing portions, using the hardware scaler module in the second rendering mode to render the surface without using the GPU to render the surface, and when determining step (c) is affirmative using the GPU and the hardware scaler module in the second rendering mode to render the surface; and (e) repeating steps (a) through (d) for the next consecutive surface.

2. A method as in claim 1, wherein the one or more additional images comprise at least one primary image generated by the graphical processing unit.

3. A method as in claim 1, further comprising:

setting a ScalerState flag to false and a SecondaryState flag to true at the initiation of a video session;

changing the ScalerState flag to true if the result of the determining step (a) is affirmative; and using the hardware scaler module to render the surface if the ScalerState flag is true and using the graphical processing unit to render the surface if the ScalerState flag is false.

4. A method as in claim 3, further comprising using the hardware scaler module to render the surface using only the source video texture if the ScalerState flag is true and the SecondaryState flag is true and using the hardware scaler module to render the surface using the source video texture and the additional images if the ScalerState flag is true and the SecondaryState flag is false.

5. A method as in claim 4, wherein the one or more additional images comprise at least one primary image generated by the graphical processing unit.

6. A method as in claim 5, further comprising:

before rendering a next consecutive surface, determining if any of the primary images have changed from those rendered as part of the previous consecutive surface and if the next consecutive source video texture is capable of being rendered using the hardware scaler module; and if the ScalerState flag for the previous consecutive surface was true, using the hardware scaler module to render the next consecutive surface with the same additional images from the previous consecutive surface and a different source video texture.

7. A method as in claim 6, wherein the one or more additional images comprise at least one a primary image generated by the graphical processing unit.

8. A mobile device including:

an operating system module with executable instructions that when executed carry out operations in response to user commands;

a display component that when executed displays continuous video content in a video session by rendering plural source video textures as consecutive surfaces on the display component;

a hardware scaler module that when executed renders a surface of the display component, the hardware scaler module having a first rendering mode and a second rendering mode, the first rendering mode comprising a secondary only optimized mode and the second rendering mode comprising a secondary/blend with primary mode;

a general purpose graphical processing unit (GPU) that when executed renders a surface of the display component, the graphical processing unit requiring greater power than the hardware scaler unit to operate, the hardware scaler unit configured to perform only a subset of graphic operations performable by the graphical processing unit; and a video rendering engine module that when executed cooperates with the operating system, wherein the hardware scaler module, the graphical processing unit, and the video rendering engine module cooperate under the control of the operating system module to perform the steps of:

(a) determining if the hardware scaler module is capable of rendering all of a particular surface, the hardware scaler module having a first rendering mode and a second rendering mode, the first rendering mode comprising a secondary-only-optimized mode and the second rendering mode comprising a secondary-only mode, wherein the hardware scaler module and the GPU are able to cooperate in a third mode comprising a secondary/blend with primary mode wherein the hardware scaler module operates in the secondary-only mode;

(b) rendering the surface using the third mode if the response to the determining step (a) is negative, the GPU requiring greater power than the hardware scaler unit to operate, the hardware scaler unit configured to perform only a subset of graphic operations performable by the graphical processing unit;

(c) determining if the particular surface to be rendered comprises one or more letterbox portions by iterating through the one or more additional images;

(d) when the determining step (a) is affirmative and the determining step (c) is not affirmative, using the hardware scaler module in the first rendering mode to render the surface, and when the determining step (a) is affirmative and the determining step (c) is affirmative, wherein surface comprises only video data renderable by the hardware scaler and one or more letterboxing portions, not using the GPU to render the surface and using the hardware scaler module in the second rendering mode to render the surface; and (e) repeating steps (a) through (d) for the next consecutive surface.

9. A device as in claim 8, wherein the steps further include:

setting a ScalerState flag to false and a SecondaryState flag to true at the initiation of a video session;

changing the ScalerState flag to true if the result of the determining step (a) is affirmative; and using the hardware scaler module to render the surface if the ScalerState flag is true and using the graphical processing unit to render the surface if the ScalerState flag is false.

10. A device as in claim 9, wherein the steps further include using the hardware scaler module to render the surface using the source video texture only if the ScalerState flag is true and the SecondaryState flag is true and using the hardware scaler module to render the surface using the source video texture and the additional images if the ScalerState flag is true and the SecondaryState flag is false.

11. A device as in claim 10, wherein the one or more additional images comprise at least one primary image generated by the graphical processing unit.

12. A device as in claim 11, wherein the steps further include:

before rendering a next consecutive surface, determining if any of the primary images have changed from those rendered as part of the previous consecutive surface and if the next consecutive source video texture is capable of being rendered using the hardware scaler module; and if the ScalerState flag for the previous consecutive surface was true, using the hardware scaler module to render the next consecutive surface with the same additional images from the previous consecutive surface and a different source video texture.

13. A device as in claim 12, wherein the one or more additional images comprise at least one of (a) blank video content generated by the hardware scaler module rendered as black areas on the display by the hardware scaler module and (b) at least one primary image generated by the graphical processing unit.

14. A device as in claim 8, further including a telephone module for communicating with a cellular telephone network.

15. A method of operating a device comprising a display, a graphics processing unit (GPU), and a hardware scaler that performs a subset of functions of the GPU and that consumes less power than the GPU, wherein the hardware scaler comprises a secondary mode and a secondary-optimized mode, and wherein the device comprises a primary-secondary-blend mode wherein the GPU and the hardware unit operate together with the hardware unit in the secondary mode, the method comprising:

rendering each surface in a sequence of surfaces to drive a display, by, for a given surface:

when determined that the given surface comprises only video data renderable by the hardware scaler and letterbox portions, rendering the given surface in the secondary mode without use of the GPU;

when determined that the given surface comprises only video data renderable by the hardware scaler, rendering the given surface in the secondary-optimized mode; and when determined that the given surface comprises letterbox portions, video data renderable by the hardware scaler, and image data not renderable by the hardware scaler, rendering the given surface with the primary-secondary-blend mode.

16. A method according to claim 15, wherein the hardware scaler comprises an MDP chipset.

17. A method according to claim 15, wherein the secondary mode comprises a mode wherein a source video texture is rendered with one or more rectangular black areas generated by the hardware scaler module.

18. A method according to claim 15, wherein performance of the method enables the device to alternate between using the hardware scaler and the GPU on a surface-by-surface basis.

19. A method according to claim 15, wherein the method is performed by a video rendering engine of the device.

20. A method according to claim 19, further comprising analyzing the surfaces for sprites by the video rendering engine, wherein the rendering each surface depends on the analyzing.

* * * * *